US011852057B2

(12) United States Patent
Himuro et al.

(10) Patent No.: US 11,852,057 B2
(45) Date of Patent: Dec. 26, 2023

(54) HEAT EXCHANGER, AND INTERNAL COMBUSTION ENGINE BLOW-BY GAS PROCESSING DEVICE

(71) Applicant: ISUZU MOTORS LIMITED, Tokyo (JP)

(72) Inventors: Yuki Himuro, Fujisawa (JP); Kotaro Kimura, Fujisawa (JP); Hiroyuki Watanabe, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 17/761,139

(22) PCT Filed: Sep. 17, 2020

(86) PCT No.: PCT/JP2020/035167
§ 371 (c)(1),
(2) Date: Mar. 16, 2022

(87) PCT Pub. No.: WO2021/054382
PCT Pub. Date: Mar. 25, 2021

(65) Prior Publication Data

US 2022/0372899 A1 Nov. 24, 2022

(30) Foreign Application Priority Data

Sep. 17, 2019 (JP) ..... 2019-168470

(51) Int. Cl.
*F01M 13/04* (2006.01)
*F02M 26/28* (2016.01)
*F01M 13/02* (2006.01)

(52) U.S. Cl.
CPC ..... *F01M 13/04* (2013.01); *F01M 13/021* (2013.01); *F02M 26/28* (2016.02);
(Continued)

(58) Field of Classification Search
CPC ..... F01M 13/04; F01M 13/021; F01M 2013/027; F01M 2013/0411;
(Continued)

(56) References Cited

U.S. PATENT DOCUMENTS 4,458,642 A 7/1984 Okubo et al.
5,499,604 A * 3/1996 Ito ..... F01M 13/021 123/573
(Continued)

FOREIGN PATENT DOCUMENTS

CN 106091751 A 11/2016
EP 2431698 A1 3/2012
(Continued)

OTHER PUBLICATIONS

Patent Cooperation Treaty, International Search Report, Application No. PCT/JP2020/035167, dated Oct. 8, 2020, in 7 pages.
(Continued)

*Primary Examiner* — George C Jin
(74) *Attorney, Agent, or Firm* — Procopio, Cory, Hargreaves & Savitch LLP

(57) ABSTRACT

This heat exchanger is provided with an inner tube 2, a first flow passage 3 formed inside the inner tube 2, an outer tube 4 disposed coaxially with the inner tube 2 on the radially outer side thereof, a second flow passage 5 formed between the inner tube 2 and the outer tube 4, annular separating walls P1 to P4 which divide the second flow passage 5 into a plurality of spaces S1 to S5 in the axial direction of the outer tube 4, and space outlets E formed in one location in the circumferential direction of each separating wall P1 to P4, wherein the spaces S1 to S5 are configured to cause a second fluid to swirl about second axes Y perpendicular to a first axis X positioned at the center of the outer tube 4.

7 Claims, 10 Drawing Sheets

(52) U.S. Cl.
CPC ..... *F01M 2013/027* (2013.01); *F01M 2013/0411* (2013.01)

(58) Field of Classification Search
CPC ..... F01M 2013/0427; F01M 13/02; F01M 5/002; F02M 26/28; F02M 26/05; F28D 7/10; F28F 1/40
See application file for complete search history.

(56) References Cited

U.S. PATENT DOCUMENTS

| | | | | | |
|---|---|---|---|---|---|
| 5,937,837 | A * | 8/1999 | Shaffer | F01M 5/002 | 123/573 |
| 2005/0109493 | A1* | 5/2005 | Wu | F02B 29/0462 | 165/157 |
| 2014/0224232 | A1* | 8/2014 | Hotta | F02B 29/0406 | 123/574 |
| 2015/0361839 | A1 | 12/2015 | Kimura et al. | | |

FOREIGN PATENT DOCUMENTS

| | | | | |
|---|---|---|---|---|
| JP | S55-035886 | A | 3/1980 | |
| JP | S57-181914 | A | 11/1982 | |
| JP | S63-116763 | | 7/1988 | |
| JP | 2004-362347 | A | 12/2004 | |
| JP | 2005-090926 | A | 4/2005 | |
| JP | 2007-163092 | A | 6/2007 | |
| JP | 2007163092 | A * | 6/2007 | |
| JP | 2008-096071 | A | 4/2008 | |
| JP | 2008096071 | A * | 4/2008 | F28D 7/106 |
| JP | 2009-243918 | A | 10/2009 | |
| JP | 2013-185545 | A | 9/2013 | |
| JP | 2014-092070 | A | 5/2014 | |
| JP | 2016-000963 | A | 1/2016 | |
| JP | 2007-118887 | A | 5/2017 | |
| JP | 2017-201154 | A | 11/2017 | |
| KR | 2009-0029891 | A | 3/2009 | |
| WO | 2005-050117 | A1 | 6/2005 | |

OTHER PUBLICATIONS

Patent Cooperation Treaty, WOSA, Application No. PCT/JP2020/035167, dated Oct. 8, 2020, in 4 pages.
Patent Cooperation Treaty, International Search Report, Application No. PCT/JP2020/022789, dated Aug. 28, 2020, in 5 pages.
Patent Cooperation Treaty, WOSA Application No. PCT/JP2020/022789, dated Aug. 28, 2020, in 3 pages.
National Intellectual Property Administration, Notification of the First Office Action, Application No. 202080065377.9, dated Jun. 28, 2023, in 14 pages.

* cited by examiner

HEAT EXCHANGER, AND INTERNAL COMBUSTION ENGINE BLOW-BY GAS PROCESSING DEVICE

CROSS-REFERENCE TO RELATED APPLICATIONS

This application is US National Stage of International Patent Application PCT/JP2020/035167, filed Sep. 17, 2020, which claims benefit of priority from Japanese Patent Application JP2019-168470, filed Sep. 17, 2019, the contents of both of which are incorporated herein by reference.

TECHNICAL FIELD

The present disclosure relates to a heat exchanger and an internal combustion engine blow-by gas processing device.

BACKGROUND ART

As a heat exchanger, a heat exchanger having a double pipe structure including an inner pipe and an outer pipe is known. In the heat exchanger, a first flow path is formed inside the inner pipe, a second flow path is formed between the inner pipe and the outer pipe, and fluids flowing in the respective flow paths exchange heat with each other.

Further, in an internal combustion engine, a blow-by gas processing device which releases blow-by gas that leaks from a gap between a piston and a cylinder into a crankcase to the atmosphere is known.

CITATION LIST

Patent Literature

Patent Literature 1: JP-A-2005-90926

SUMMARY OF INVENTION

Technical Problem

In a blow-by gas processing device, an oil separator which separates oil from blow-by gas by using compressed air generated by a compressor can be considered. In such a blow-by gas processing device, by using the heat exchanger described above, for example, the compressed air introduced into the oil separator can exchange heat with engine cooling water discharged from an EGR cooler. As a result, it is possible to reduce damage to the oil separator due to heat of the compressed air.

By the way, when the heat exchanger described above is used, a heat exchange area can be increased by lengthening a length of the outer pipe and forming the second flow path long in an axial direction of the outer pipe.

However, even when the heat exchange area is increased, if the residence time of fluid in the second flow path is short, heat exchange with the fluid flowing in the first flow path may not be sufficiently promoted.

Therefore, the present disclosure is devised in view of such circumstances, and an object thereof is to provide a heat exchanger having a double pipe structure including an inner pipe and an outer pipe, which can sufficiently promote heat exchange, and an internal combustion engine blow-by gas processing device including the heat exchanger.

Solution to Problem

According to an aspect of the present disclosure, there is provided a heat exchanger including:

an inner pipe;

a first flow path which is formed inside the inner pipe and through which a first fluid flows;

an outer pipe which is coaxially arranged on an outer side of the inner pipe in a radial direction;

a second flow path which is formed between the inner pipe and the outer pipe and through which a second fluid flows;

a partition wall which has an annular shape and which divides the second flow path into a plurality of spaces in an axial direction of the outer pipe; and a space outlet which is formed at one location, in a circumferential direction, of the partition wall and which allows the second fluid to flow from the space on an upstream side to the space on a downstream side, in which the space is configured to swirl the second fluid around a second axis orthogonal to a first axis located at a center of the outer pipe.

Preferably, the partition wall is formed in a C shape.

Preferably, an inlet portion which is formed on an outer peripheral surface of the outer pipe and which introduces the second fluid into the second flow path is further provided, in which a third axis located at a center of the inlet portion is orthogonal to the first axis and the second axis.

Preferably, a length of the space in an axial direction of the first axis is set to be identical to an inner diameter of the outer pipe.

Preferably, a plurality of the partition walls are provided, and the space outlets of the partition walls adjacent to each other are arranged at positions axially symmetric with each other with respect to the first axis.

According to another aspect of the present disclosure, there is provided a blow-by gas processing device for an internal combustion engine including the heat exchanger, in which the internal combustion engine includes:

an intake passage;

a compressor of a turbocharger which is installed in the intake passage; and a refrigerant passage through which refrigerant, as a first fluid, flows, in which the blow-by gas processing device further includes:

a blow-by gas passage through which blow-by gas flows;

an oil separator which is provided in the blow-by gas passage and which separates oil from blow-by gas by using compressed air, as a second fluid, generated by the compressor; and an air passage which takes out compressed air from the intake passage further on the downstream side than the compressor and which introduces the compressed air into the oil separator, in which refrigerant is introduced into a first flow path of the heat exchanger from the refrigerant passage, and in which a second flow path of the heat exchanger forms a part of the air passage.

Preferably, the internal combustion engine includes an EGR passage which recirculates EGR gas into the intake passage and an EGR cooler which is provided in the EGR passage and which exchanges heat between the EGR gas and refrigerant introduced from the refrigerant passage, and in which refrigerant discharged from the EGR cooler is introduced into the first flow path of the heat exchanger.

Advantageous Effects of Invention

According to the present disclosure, it is possible to provide a heat exchanger having a double pipe structure including an inner pipe and an outer pipe, which can sufficiently promote heat exchange, and an internal combustion engine blow-by gas processing device including the heat exchanger.

DESCRIPTION OF EMBODIMENTS

Hereinafter, embodiments of the present disclosure will be described with reference to the accompanying drawings. It should be noted that the present disclosure is not limited to the following embodiments. Further, each direction of up, down, front, rear, left, and right shown in the figure coincides with each direction of a vehicle (not illustrated) equipped with an internal combustion engine 10, although each direction is only defined for convenience of explanation.

Figure 1:
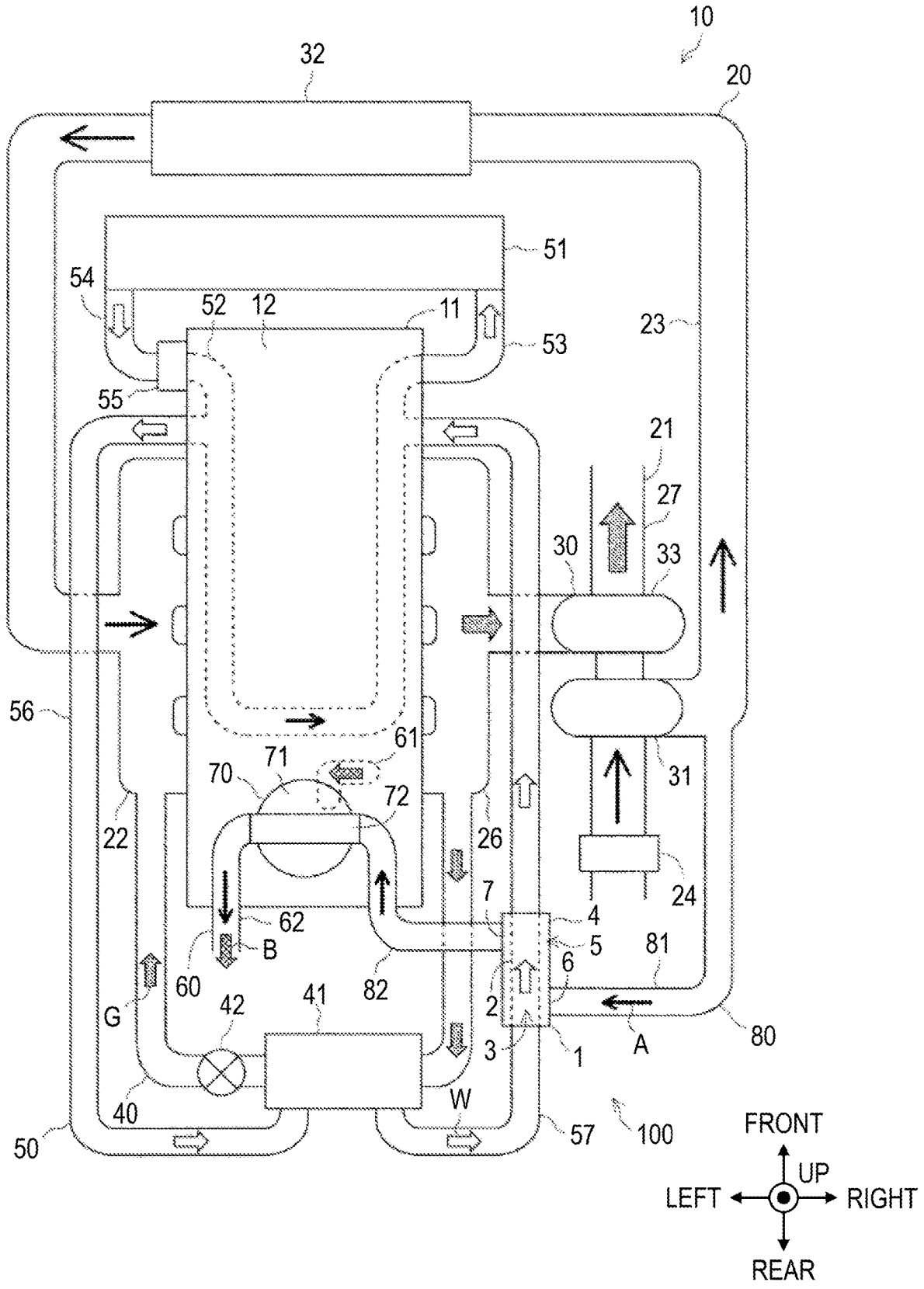
FIG. 1 is an overall configuration diagram of an internal combustion engine including a blow-by gas processing device.

FIG. 1 is an overall configuration diagram of an internal combustion engine 10 including a blow-by gas processing device 100. In the figure, the arrow A indicates the flow of intake or compressed air, and the arrow B indicates the flow of blow-by gas. Further, the arrow G indicates the flow of exhaust gas or EGR gas, and the arrow W indicates the flow of engine cooling water as a refrigerant.

As illustrated in FIG. 1, the internal combustion engine 10 is a multi-cylinder compression ignition type internal combustion engine, that is, a diesel engine mounted on a vehicle. The vehicle is a large vehicle such as a truck. However, the type, model, application, and the like of the vehicle and the internal combustion engine 10 are not particularly limited. For example, the vehicle may be a small vehicle such as a passenger car, and the internal combustion engine 10 may be a spark ignition type internal combustion engine, that is, a gasoline engine. The internal combustion engine 10 may be mounted on a moving body other than a vehicle, for example, a ship, a construction machine, or an industrial machine. Further, the internal combustion engine 10 does not have to be mounted on a moving body, and may be a stationary engine.

The internal combustion engine 10 includes an engine main body 11, an intake passage 20 and an exhaust passage 21 connected to the engine main body 11, and a compressor 31 of a turbocharger 30 provided in the intake passage 20. Further, the internal combustion engine 10 includes an EGR pipe 40 as an EGR passage, an EGR cooler 41 provided in the EGR pipe 40, and a cooling water passage 50, as a refrigerant passage, through which engine cooling water flows.

Although not illustrated, the engine main body 11 includes structural parts such as a cylinder head, a cylinder block, and a crankcase, and moving parts such as a piston, a crankshaft, and a valve accommodated in the structural parts. The reference numeral 12 indicates a head cover connected to the upper part of the cylinder head.

The intake passage 20 is mainly defined by an intake manifold 22 connected to the engine main body 11 (particularly, a cylinder head) and an intake pipe 23 connected to an upstream end of the intake manifold 22. The intake manifold 22 distributes and supplies the intake air, sent from the intake pipe 23, to an intake port of each cylinder. The intake pipe 23 is provided with an air cleaner 24, the compressor 31 of the turbocharger 30, and an intercooler 32 in this order from an upstream side.

The exhaust passage 21 is mainly defined by an exhaust manifold 26 connected to the engine main body 11 (particularly, a cylinder head) and an exhaust pipe 27 arranged on a downstream side of the exhaust manifold 26. The exhaust manifold 26 collects the exhaust gas sent from an exhaust port of each cylinder. A turbine 33 of the turbocharger 30 is provided between the exhaust manifold 26 and the exhaust pipe 27.

The compressor 31 is configured to generate compressed air by compressing the intake air flowing through the intake pipe 23 by rotationally driving the compressor 31 with a rotational force of the turbine 33. The intercooler 32 is configured to cool the compressed air generated by the compressor 31.

The EGR pipe 40 is configured to recirculate a part (EGR gas) of the exhaust gas in the exhaust passage 21 into the intake passage 20.

The EGR pipe 40 of the present embodiment forms a so-called high-pressure EGR device, and an upstream end of the EGR pipe 40 is connected to the exhaust manifold 26, and a downstream end of the EGR pipe 40 is connected to the intake manifold 22. However, the EGR pipe 40 may form a so-called low-pressure EGR device. In this case, the upstream end of the EGR pipe 40 may be connected to the exhaust pipe 27, and the downstream end of the EGR pipe 40 may be connected to a part of the intake pipe 23, which is the part located further on the upstream side than the compressor 31.

The EGR pipe 40 is provided with the EGR cooler 41 and an EGR valve 42 in this order from the upstream side. The EGR cooler 41 makes the EGR gas exchange heat with the engine cooling water flowing through the cooling water passage 50 described below. The EGR valve 42 is configured to adjust the flow rate of the EGR gas.

The cooling water passage 50 includes a radiator 51 for cooling the engine cooling water, and an engine inner water passage 52 formed inside the engine main body 11 (particularly, the cylinder block and the cylinder head). Further, the cooling water passage 50 includes a water supply pipe 53 for sending engine cooling water from the engine inner water passage 52 to the radiator 51, and a return pipe 54 for returning the engine cooling water from the radiator 51 to the engine inner water passage 52.

An upstream end of the water supply pipe 53 is connected to a downstream end of the engine inner water passage 52, and a downstream end of the water supply pipe 53 is connected to a cooling water inlet of the radiator 51. Further, an upstream end of the return pipe 54 is connected to a cooling water outlet of the radiator 51, and a downstream end of the return pipe 54 is connected to an upstream end of the engine inner water passage 52 via a water pump 55.

Further, the cooling water passage 50 of the present embodiment includes a water feed pipe 56 for supplying engine cooling water to the EGR cooler 41, and a drain pipe 57 for discharging the engine cooling water from the EGR cooler 41.

An upstream end of the water feed pipe 56 is connected to the engine inner water passage 52 located directly downstream of the water pump 55, and a downstream end of the water feed pipe 56 is connected to a cooling water inlet of the EGR cooler 41. An upstream end of the drain pipe 57 is connected to a cooling water outlet of the EGR cooler 41, and a downstream end of the drain pipe 57 is connected to the engine inner water passage 52 located directly upstream of the water supply pipe 53. Although not illustrated, the drain pipe 57 is provided with a thermostat, a heater, and the like for adjusting the temperature of the engine cooling water.

The blow-by gas processing device 100 includes a blow-by gas passage 60, through which blow-by gas flows. As is well known, blow-by gas is gas that leaks from a gap between the cylinder and the piston into the crankcase, in the engine main body 11.

Further, the blow-by gas processing device 100 includes an oil separator 70, which is provided in the blow-by gas passage 60 and separates oil from the blow-by gas by using the compressed air generated by the compressor 31.

Further, the blow-by gas processing device 100 includes an air passage 80, for taking out compressed air from the intake passage 20 further on the downstream side than the compressor 31, and for introducing the compressed air into the oil separator 70.

The blow-by gas passage 60 includes an upstream gas passage 61 arranged further on the upstream side in a blow-by gas flow direction than the oil separator 70, and a blow-by gas pipe 62 arranged further on the downstream side than the oil separator 70.

The upstream gas passage 61 extends from the inside of the crankcase, through the cylinder block and the cylinder head, into the head cover 12.

The blow-by gas pipe 62 is made of a resin material or a metal material, and is exposed to the outside. Further, a downstream end of the blow-by gas pipe 62 is open to the atmosphere, in the case of the present embodiment.

Figure 2:
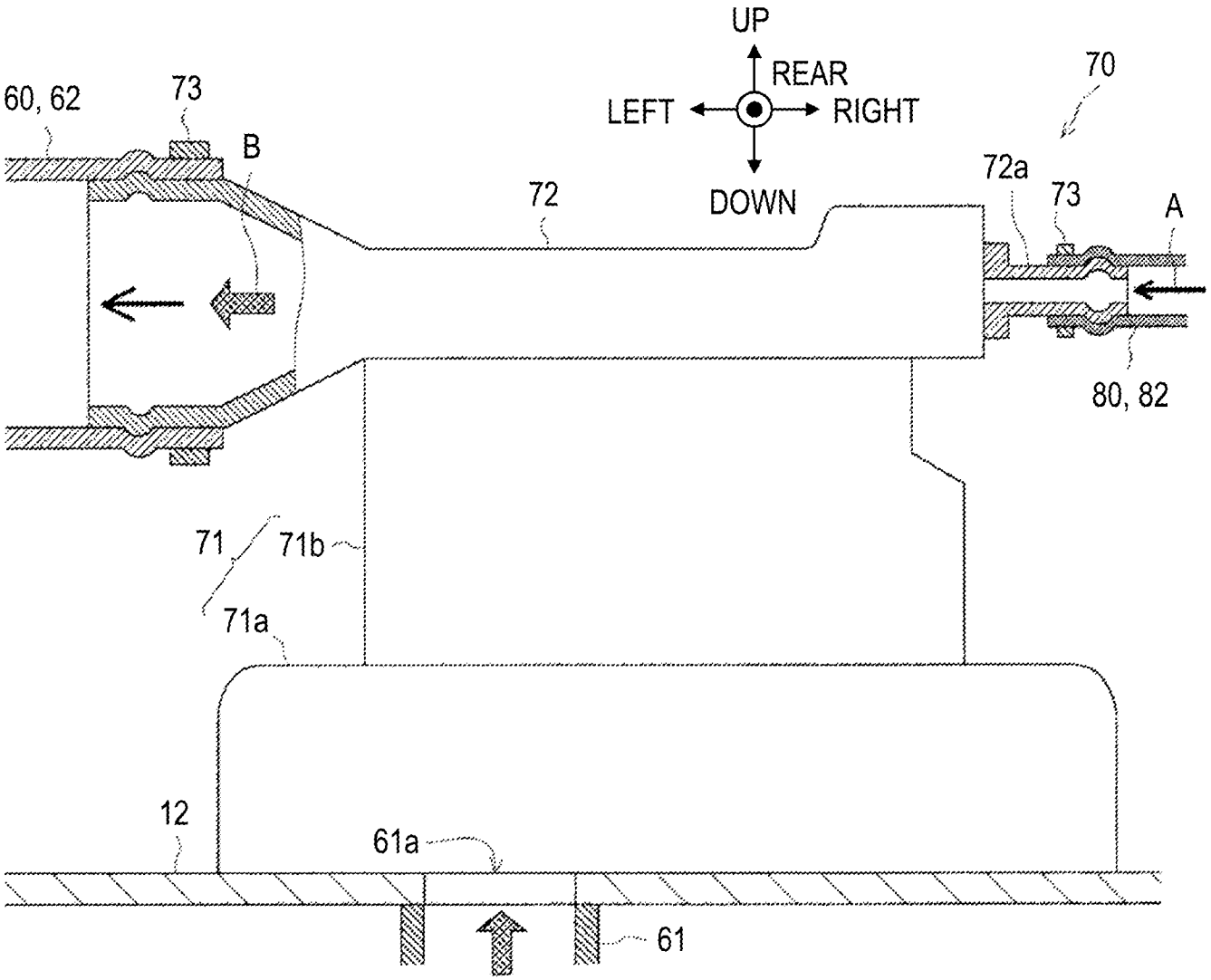
FIG. 2 is a partial cross-sectional view illustrating a schematic configuration of an oil separator.

As illustrated in FIG. 2, the oil separator 70 is installed above the head cover 12. A gas outlet 61*a* of the upstream gas passage 61 is formed on an upper portion of the head cover 12.

The oil separator 70 includes an oil separation portion 71, which introduces blow-by gas from the gas outlet 61*a* of the upstream gas passage 61, and separates oil from the blow-by gas. In addition, the oil separator 70 includes a gas suction portion 72, which introduces compressed air from the air passage 80 to generate a negative pressure, and sucks the blow-by gas, by using the negative pressure, after the oil is separated by the oil separation portion 71.

The oil separation portion 71 includes a lower casing 71*a* connected to an upper surface portion of the head cover 12 and an upper casing 71*b* connected to an upper surface portion of the lower casing 71*a*.

The lower casing 71*a* communicates with the upstream gas passage 61 and the upper casing 71*b*. The upper casing 71*b* is configured to make the blow-by gas introduced from the lower casing 71*a* collide with a wall to separate the oil from the blow-by gas.

The gas suction portion 72 is formed in a tubular shape extending in a left-right direction, and is supported on the upper casing 71*b*. Further, the gas suction portion 72 blows out the introduced compressed air from an orifice, and sucks the blow-by gas from the upper casing 71*b* by using the negative pressure generated by the blowing-out.

At an upstream end of the gas suction portion 72, an introduction portion 72*a* for introducing compressed air from a downstream air pipe 82, which will be described below, is provided. The introduction portion 72*a* is formed in a tubular shape, and is fitted and connected to a downstream end portion of the downstream air pipe 82. On the other hand, an upstream end portion of the blow-by gas pipe 62 is fitted and connected to a downstream end portion of the gas suction portion 72. These are detachably connected by fastening members 73, such as a metal band.

Returning to FIG. 1, the air passage 80 includes an upstream air pipe 81 arranged on an upstream side of a heat exchanger 1 described below, and the downstream air pipe 82 arranged on a downstream side of the heat exchanger 1 in a compressed air flow direction. An upstream end of the upstream air pipe 81 is connected to the intake pipe 23 located between the compressor 31 and the intercooler 32. On the other hand, a downstream end of the downstream air pipe 82 is connected to the upstream end of the gas suction portion 72.

In the present embodiment, as illustrated by the arrow B in FIG. 1, during the operation of the internal combustion engine 10, the blow-by gas in the crankcase flows through the upstream gas passage 61, the oil separator 70, and the blow-by gas pipe 62 in this order, and is released into the atmosphere.

In the compressor 31, the intake air is compressed to generate compressed air. The compressed air is cooled by the intercooler 32 and introduced into the combustion chamber of the engine main body 11. Further, the compressed air is taken out from the intake pipe 23 further on the upstream side than the intercooler 32 to the upstream air pipe 81, and is introduced into the oil separator 70 from the downstream air pipe 82. The oil separator 70 utilizes the compressed air to separate oil from the blow-by gas.

Specifically, as illustrated in FIG. 2, in the oil separator 70, the blow-by gas is sucked from the upper casing 71*b* of the oil separation portion 71 by using the negative pressure generated by the compressed air flowing through the gas suction portion 72, and then the sucked blow-by gas is discharged from the blow-by gas pipe 62 together with the compressed air. In this way, the suction of the blow-by gas causes a flow of blow-by gas shown by the arrow.

The blow-by gas before oil separation introduced into the upper casing 71*b*, through the lower casing 71*a*, from the upstream gas passage 61 collides with the wall of the upper casing 71*b*. As a result, the oil contained in the blow-by gas adheres to the wall of the upper casing 71*b*, and the oil is separated from the blow-by gas.

The blow-by gas after oil separation is sucked into the gas suction portion 72 from the upper casing 71*b*, and discharged to the blow-by gas pipe 62 together with the compressed air. Further, the oil separated from the blow-by gas is returned into the crankcase through a return passage (not illustrated).

By the way, the compressed air generated by the compressor 31 may become high temperature (for example, 190° C. or higher) during, for example, high load operation of the internal combustion engine 10. Therefore, when it is assumed that the high-temperature compressed air is taken out from the intake pipe 23 further on the upstream side than the intercooler 32 to the air passage 80, and introduced into the oil separator 70 at a high temperature, the heat of the compressed air may damage the oil separator 70 (particularly, the gas suction portion 72).

Therefore, the blow-by gas processing device 100 of the present embodiment includes the heat exchanger 1 having a double pipe structure, to cool the compressed air flowing through the air passage 80.

Figure 3:
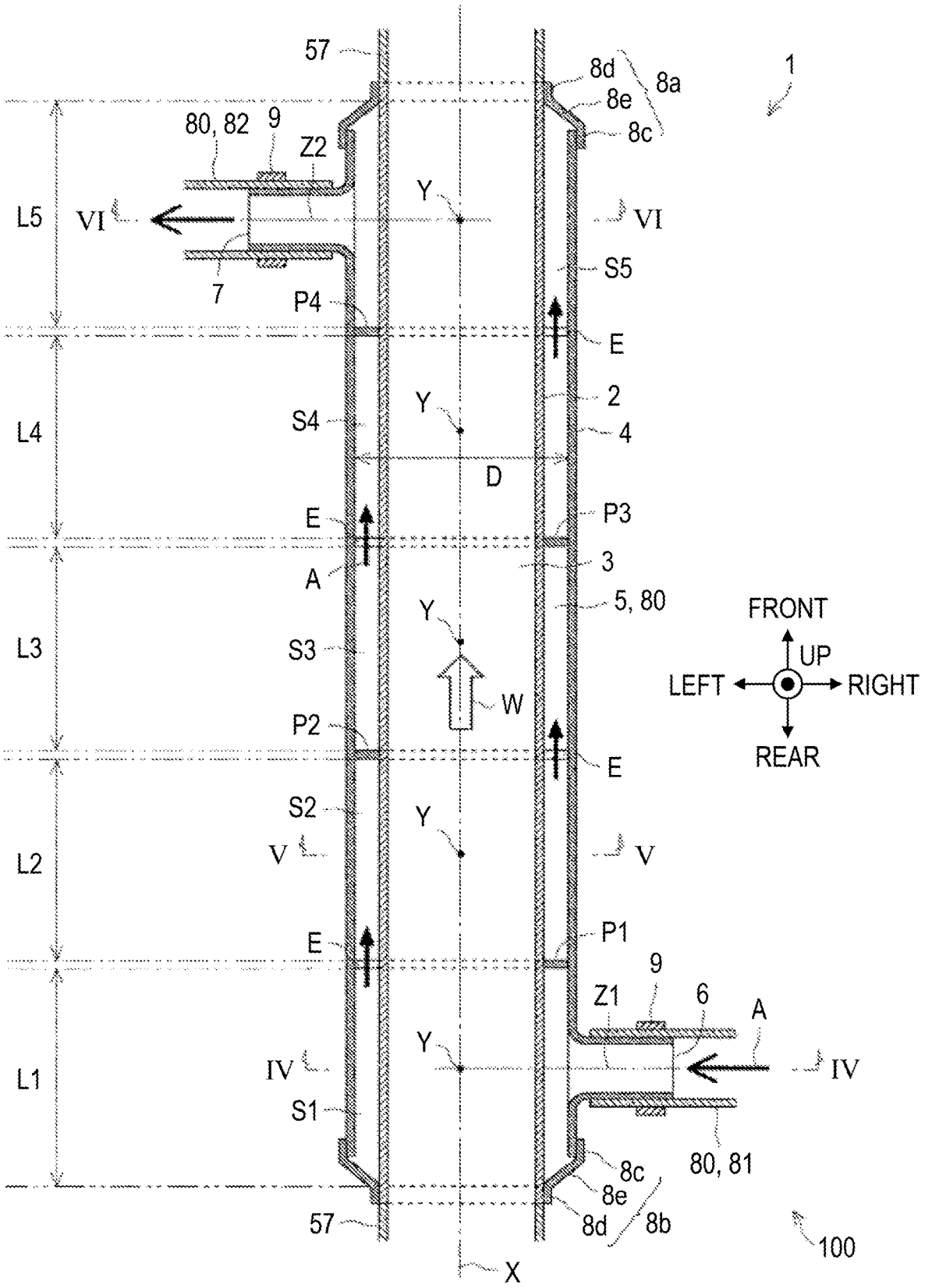
FIG. 3 is a plan sectional view illustrating a schematic configuration of a heat exchanger.

As illustrated in FIGS. 1 and 3, the heat exchanger 1 includes an inner pipe 2 and a cooling water flow path 3, as a first flow path, formed inside the inner pipe 2. Engine cooling water (refrigerant), as the first fluid, flows in the cooling water flow path 3.

Further, the heat exchanger 1 includes an outer pipe 4 coaxially arranged on an outer side of the inner pipe 2 in a radial direction, an air flow path 5, as a second flow path, formed between the inner pipe 2 and the outer pipe 4, and an inlet portion 6 and an outlet portion 7 formed on an outer peripheral surface of the outer pipe 4. The compressed air, as a second fluid, flows in the air flow path 5. The term "coaxial" as used herein means a state in which axes are coaxial or the axes are slightly tilted and offset.

In FIG. 3, the reference letter X indicates a first axis (hereinafter, a pipe axis) located at the center of the outer pipe 4, and the reference letter Y indicates a second axis (hereinafter, an orthogonal axis with respect to the pipe axis X) orthogonal to the pipe axis X. Further, the reference letter Z1 indicates a third axis (hereinafter, a central axis of the inlet portion 6) located at the center of the inlet portion 6, and the alternate long and short dash line Z2 indicates a fourth axis (hereinafter, a central axis of the outlet portion 7) located at the center of the outlet portion 7. The central axis Z1 of the inlet portion 6 and the central axis Z2 of the outlet portion 7 are orthogonal to the pipe axis X and the orthogonal axis Y.

The inner pipe 2 is provided in the middle of the drain pipe 57 further on the downstream side than the EGR cooler 41 in the cooling water flow direction. The inner pipe 2 of the present embodiment is integrally formed with the drain pipe 57.

The cooling water flow path 3 introduces the engine cooling water from the drain pipe 57 further on the upstream side than the inner pipe 2, and discharges the engine cooling water to the drain pipe 57 further on the downstream side than the inner pipe 2.

The outer pipe 4 has an inner diameter larger than the outer diameter of the inner pipe 2, and is arranged to cover the inner pipe 2. The inner pipe 2 and the outer pipe 4 are arranged coaxially with each other, and have a common pipe axis X extending linearly in the front-rear direction. However, the pipe axis X may be curved.

Both ends of the outer pipe 4 in the axial direction are closed. In the present embodiment, a front seal member 8*a*, which seals a gap between a front end of the outer pipe 4 and the outer peripheral surface of the inner pipe 2, and a rear seal member 8*b*, which seals a gap between a rear end of the outer pipe 4 and the outer peripheral surface of the inner pipe 2, are provided.

As the seal members 8*a* and 8*b*, plate members formed in an annular shape are used. Each of the seal members 8*a* and 8*b* have an S-shaped bent cross-sectional shape from an outer peripheral portion 8*c* to an inner peripheral portion 8*d*. The outer peripheral portions 8*c* of the seal members 8*a* and 8*b* are bent in parallel with the outer pipe 4, and abut on the outer peripheral surface of the outer pipe 4 over the entire circumference. The inner peripheral portions 8*d* of the seal members 8*a* and 8*b* are bent in parallel with the inner pipe 2, and abut on the outer peripheral surface of the inner pipe 2 over the entire circumference. These abutment portions are fixed by welding or the like. Further, each of the seal members 8*a* and 8*b* has a tapered wall portion 8*e*, between the outer peripheral portion 8*c* and the inner peripheral portion 8*d*, whose diameter is reduced as the seal member extends in a direction away from the outer pipe 4 in the axial direction.

The air flow path 5 is defined in an annular shape in a gap between the inner pipe 2 and the outer pipe 4, and forms a part of the air passage 80. In the air flow path 5, compressed air flows from the inlet portion 6 to the outlet portion 7.

The inlet portion 6 is provided on a right side surface of the rear end portion of the outer pipe 4, and introduces compressed air from the upstream air pipe 81 to the air flow path 5. The outlet portion 7 is provided on a left side surface of the front end portion of the outer pipe 4, and discharges compressed air from the air flow path 5 to the downstream air pipe 82. However, the inlet portion 6 and the outlet portion 7 may be provided at end portions of the outer pipe 4, that is, at the positions of the seal members 8*a* and 8*b*.

In the present embodiment, the inlet portion 6 and the outlet portion 7 are formed in a tubular shape protruding outward in the radial direction from the outer pipe 4. The downstream end portion of the upstream air pipe 81 is fitted and connected to the inlet portion 6. The upstream end portion of the downstream air pipe 82 is fitted and connected to the outlet portion 7. These are detachably connected by fastening members 9, such as a metal band.

According to the heat exchanger 1 of the present embodiment, heat can be exchanged between the compressed air flowing through the air flow path 5 and the engine cooling water flowing through the cooling water flow path 3, via the inner pipe 2. As a result, the high-temperature compressed air taken out from the intake pipe 23 further on the upstream side than the intercooler 32 to the air passage 80 can be cooled before being introduced into the oil separator 70. As a result, it is possible to reduce the introduction of compressed air into the oil separator 70 at a high temperature, and thus it is possible to reduce damage to the oil separator 70 due to the heat of the compressed air.

On the other hand, the compressed air generated by the compressor 31 may have a low temperature (for example, 14° C. or lower) in an environment where the atmospheric temperature is low, for example. Therefore, when it is assumed that the heat exchanger 1 is not provided in the air passage 80, the temperature of the blow-by gas may be excessively lowered by the low-temperature compressed air. As a result, the moisture contained in the blow-by gas may adhere to the inside of the blow-by gas pipe 62 and freeze, resulting in blockage of the blow-by gas pipe 62.

On the other hand, in the present embodiment, the low-temperature compressed air taken out from the intake pipe 23 to the air passage 80 can be heated by the engine cooling water in the heat exchanger 1. As a result, it is possible to prevent the compressed air from being introduced into the oil separator 70 at a low temperature and excessively lowering the temperature of the blow-by gas. As a result, it is possible to prevent the moisture contained in the blow-by gas from adhering to the inside of the blow-by gas pipe 62 and freezing, so that the blockage of the blow-by gas pipe 62 can be reduced.

Further, the heat exchanger 1 of the present embodiment exchanges heat between the compressed air and the engine cooling water further on the downstream side in the cooling water flow direction than the EGR cooler 41. That is, since the engine cooling water after heat exchange with the EGR gas by the EGR cooler 41 is used, the compressed air can be cooled without degrading the cooling performance of the EGR cooler 41.

By the way, in general, when such a heat exchanger having a double pipe structure is used, the heat exchange area can be increased by lengthening the length of the outer pipe and extending the air flow path, in the axial direction of the outer pipe.

However, even in a case where the heat exchange area is increased, for example, if compressed air flows only in the axial direction of the outer pipe in the air flow path, the residence time of the compressed air in the air flow path is short. Therefore, heat exchange with engine cooling water may not be sufficiently promoted.

On the other hand, as illustrated in FIGS. 3 to 6, the heat exchanger 1 of the present embodiment includes a plurality of partition walls P1 to P4, which partition the air flow path 5 into a plurality of spaces S1 to S5 in the axial direction of the outer pipe 2. Further, the heat exchanger 1 includes space outlets E, each of which is formed at one location in the circumferential direction of each of partition walls P1 to P4, and which allow compressed air to flow from the upstream space to the downstream space.

Each of the partition walls P1 to P4 is formed in a C shape, and is arranged coaxially with the pipe axis of the outer pipe X. Outer peripheral surfaces of the partition walls P1 to P4 abut on the inner peripheral surface of the outer pipe 4, and inner peripheral surfaces of the partition walls P1 to P4 abut on the outer peripheral surface of the inner pipe 2. Further, these abutment portions are fixed by welding or the like.

In the present embodiment, in the axial direction of the outer pipe 4, the first to fourth partition walls P1 to P4 are provided at equal intervals in order, from the inlet portion 6 side to the outlet portion 7 side.

A first space S1 is partitioned by the rear seal member 8*b* and the first partition wall P1. A second space S2 is partitioned by the first partition wall P1 and the second partition wall P2. A third space S3 is partitioned by the second partition wall P2 and the third partition wall P3. A fourth space S4 is partitioned by the third partition wall P3 and the fourth partition wall P4. A fifth space S5 is partitioned by the fourth partition wall P4 and the front seal member 8*a*. The reference letters and numerals L1 to L5 indicate the lengths of the spaces S1 to S5 in the axial direction of the outer pipe 4, respectively.

In the axial direction of the outer pipe 4, the inlet portion 6 is located in the middle portion of the first space S1, and the outlet portion 7 is located in the middle portion of the fifth space S5. The compressed air introduced into the first space S1 from the inlet portion 6 flows in the order of the second space S2, the third space S3, the fourth space S4, and the fifth space S5, through the respective space outlets E of the first to fourth partition walls P1 to P4, and is discharged from the outlet portion 7.

The inlet portion 6, the respective space outlets E of the first to fourth partition walls P1 to P4, and the outlet portion 7 are alternately arranged at positions axially symmetric with respect to the pipe axis X (positions where the circumferential angle around the pipe axis X differs by 180°). That is, in the circumferential direction of the outer pipe 4, the space outlet E of the first partition wall P1 is arranged at a position axially symmetric with the inlet portion 6, and the space outlets E of the adjacent partition walls P1 to P4 are arranged at positions axially symmetric with one another. The outlet portion 7 is arranged at a position axially symmetric with the space outlet E of the fourth partition wall P4. In the present embodiment, the inlet portion 6 and the outlet portion 7 are arranged at positions axially symmetric with respect to the pipe axis X, and the number of partition walls P1 to P4 is an even number (four). Therefore, the inlet portion 6, the space outlets E of the partition walls P1 to P4, and the outlet portion 7 can be arranged alternately.

When the arrangement is staggered as described above, in the circumferential direction of each of the spaces S1 to S5, the positions of the inlet portion 6 and the space outlet E of the first partition wall P1, the positions of the space outlets E of the adjacent partition walls P1 to P4, and the positions of the space outlet E of the fourth partition wall P4 and the outlet portion 7 can be set to the farthest positions in the circumferential direction. As a result, the residence time of the compressed air can be lengthened in each of the spaces S1 to S5.

Figure 4:
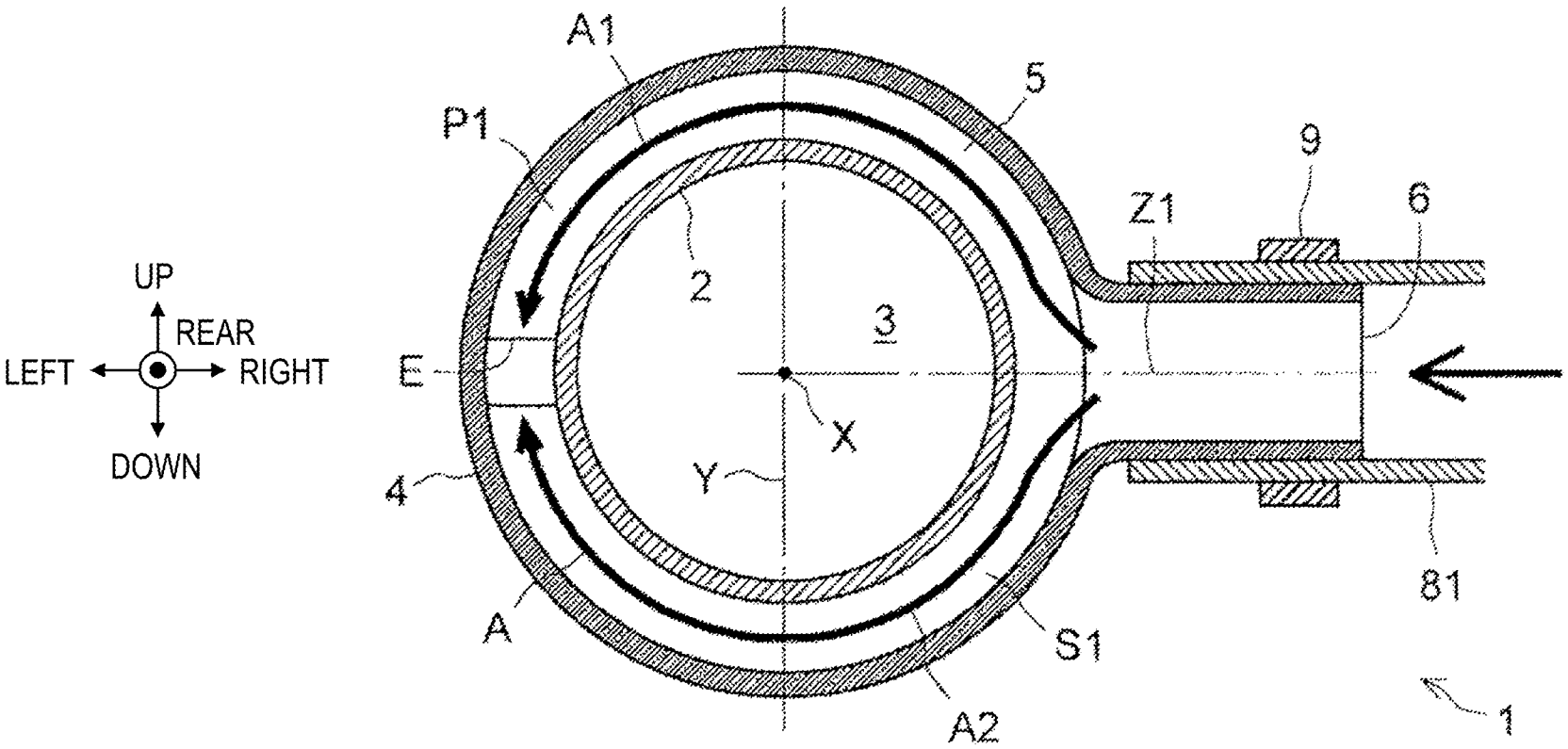
FIG. 4 is a cross-sectional view taken along the line IV-IV of FIG. 3.
Figure 5:
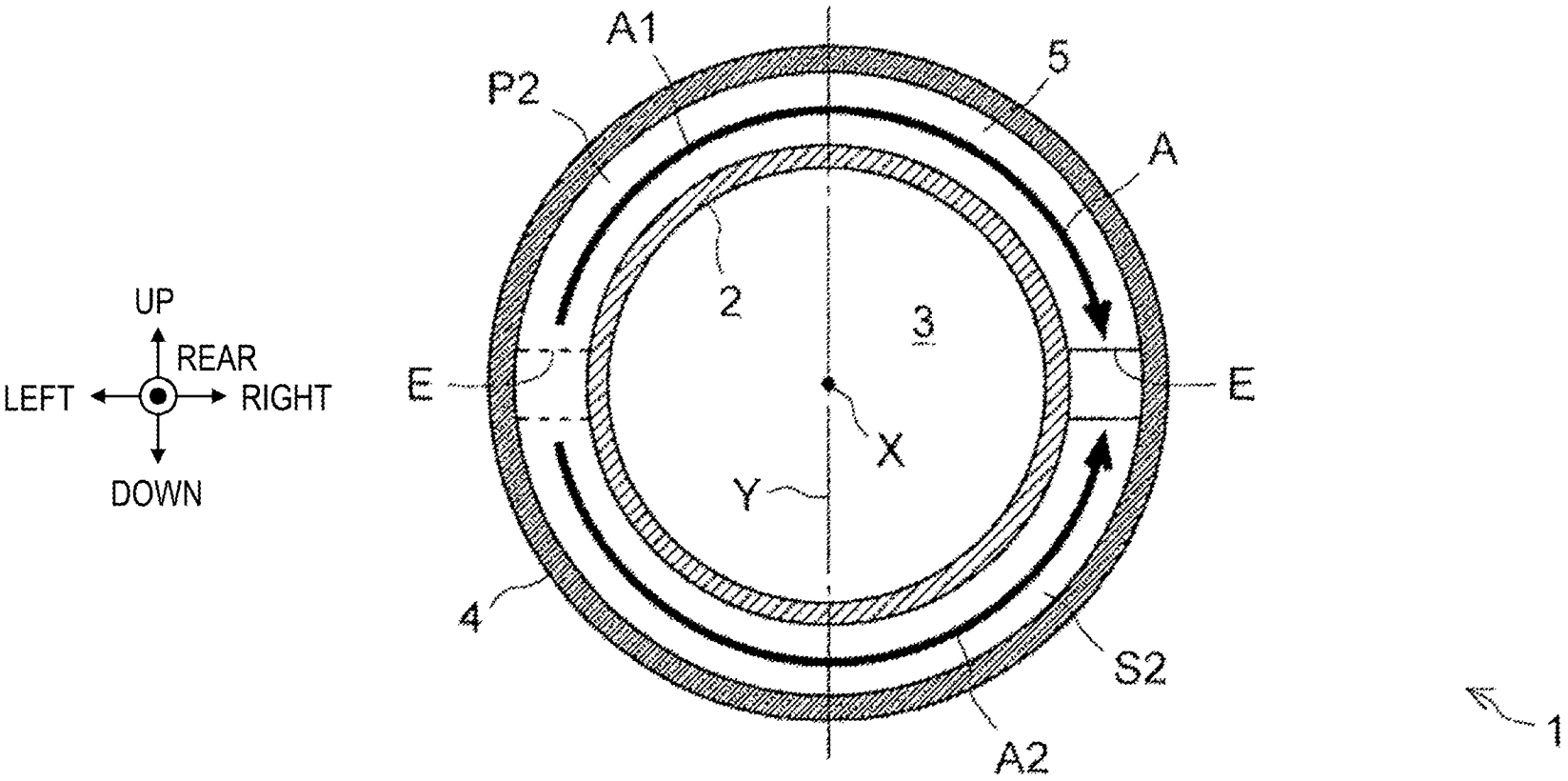
FIG. 5 is a cross-sectional view taken along the line V-V of FIG. 3.
Figure 6:
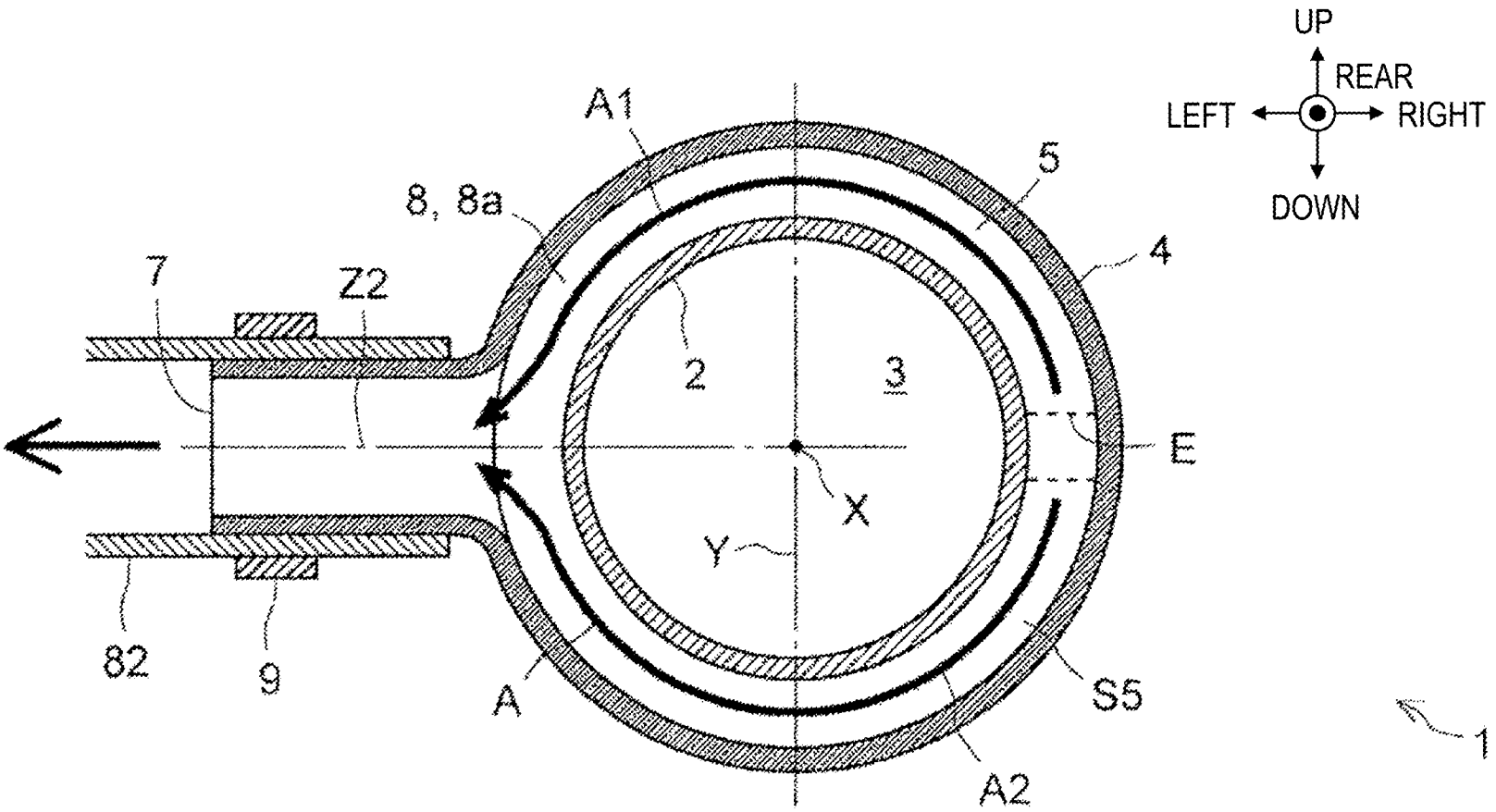
FIG. 6 is a cross-sectional view taken along the line VI-VI of FIG. 3.

As illustrated in FIGS. 4 to 6, in each of the spaces S1 to S5, two compressed air flows A1 and A2, one on the upper side and the other on the lower side, formed axially symmetric with respect to the pipe axis X are formed.

Figure 7:
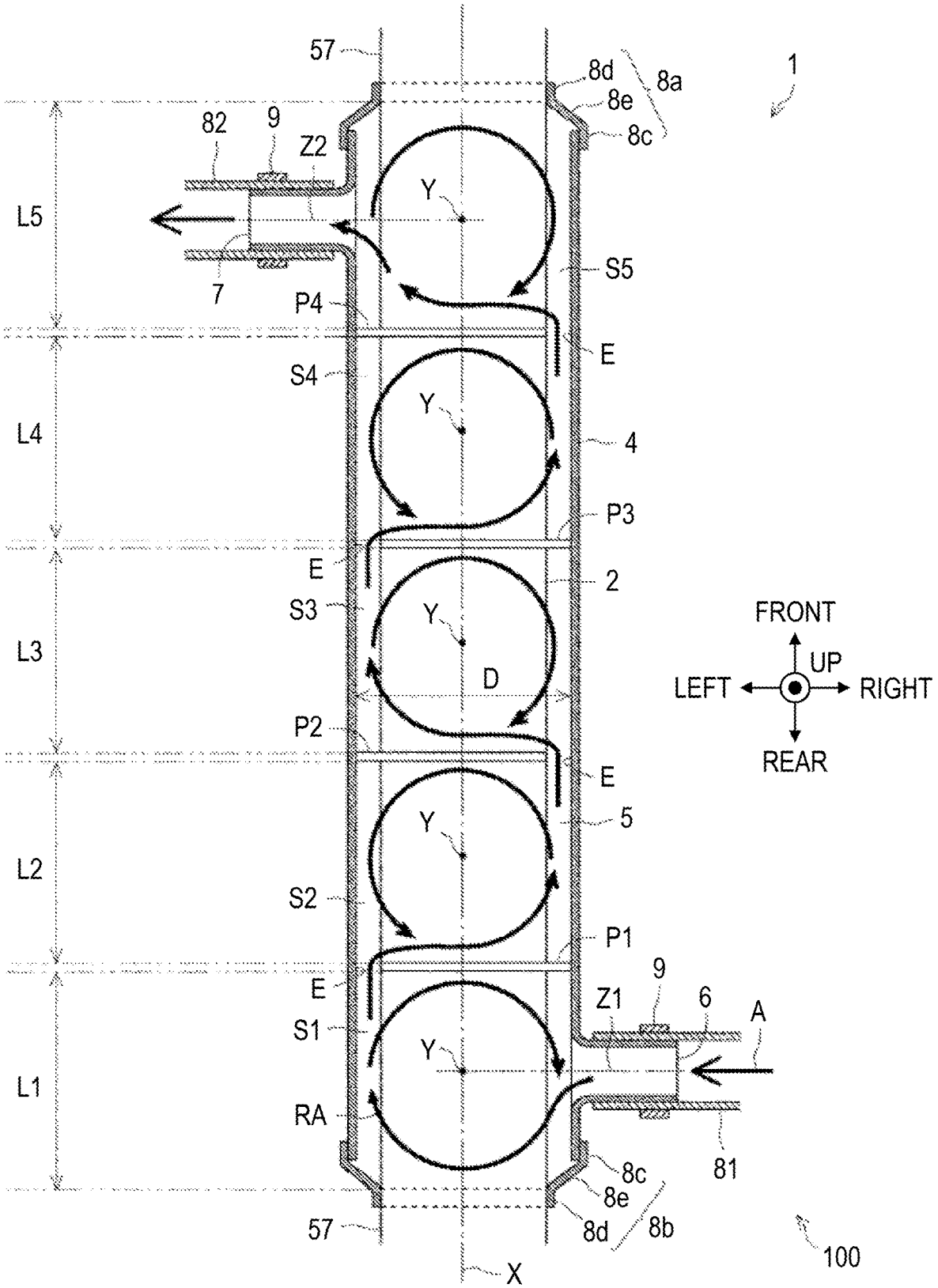
FIG. 7 is a top view illustrating a flow of a second fluid (compressed air) in the heat exchanger.
Figure 8:
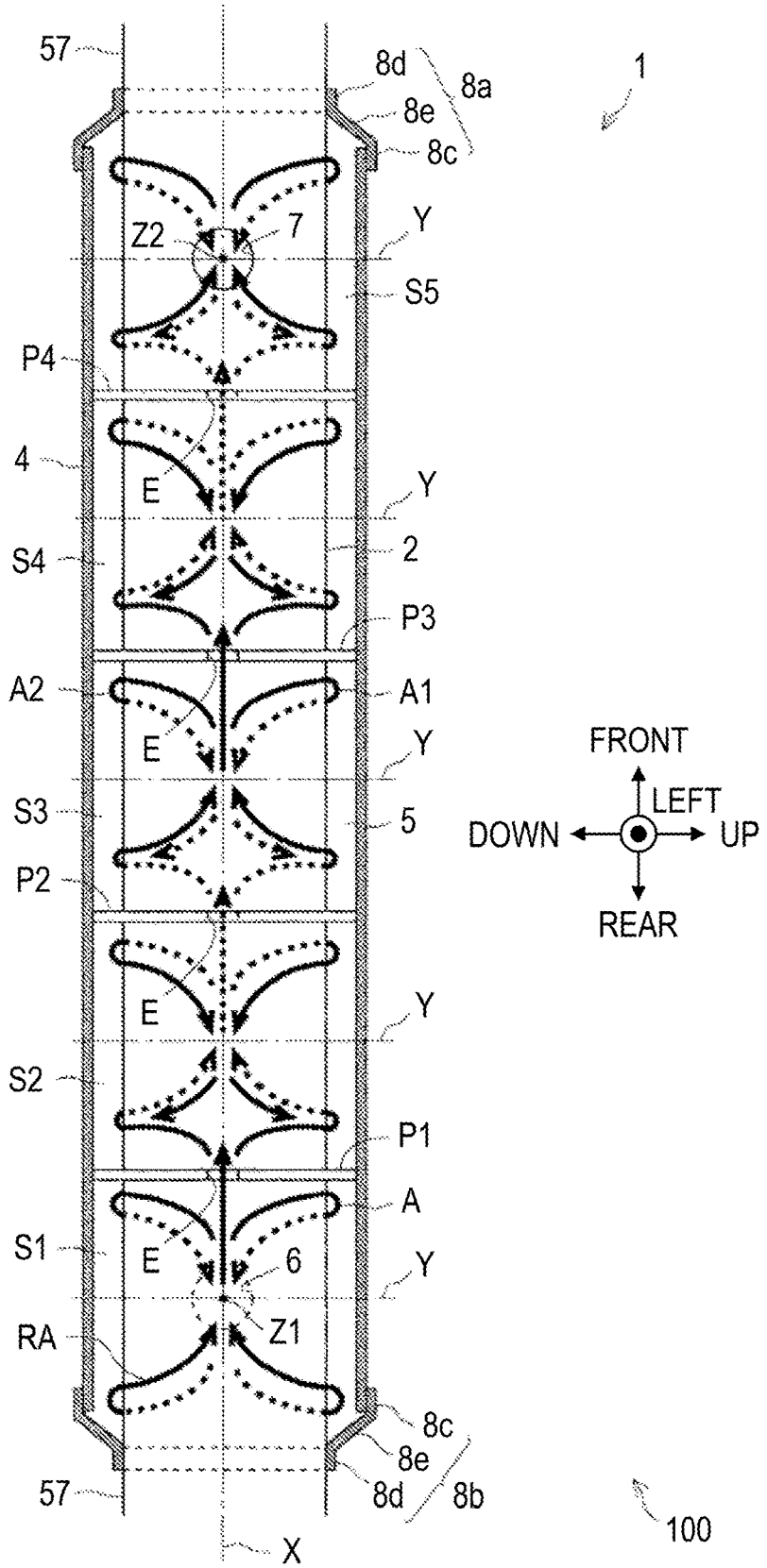
FIG. 8 is a left side view illustrating the flow of the second fluid (compressed air) in the heat exchanger.

Further, in the present embodiment, as indicated by the arrows A in FIGS. 7 and 8, each of the spaces S1 to S5 is configured to swirl compressed air around the orthogonal axis Y orthogonal to the pipe axis X of the outer pipe 4.

Specifically, the lengths L1 to L5 of the respective spaces S1 to S5 in the axial direction of the pipe axis X are set to the lengths at which compressed air can swirl around the orthogonal axis Y. In the present embodiment, the lengths L1 to L5 of the respective spaces S1 to S5 are set to be the same as an inner diameter D of the outer pipe 4.

The swirling of the compressed air will be explained in detail. In the first space S1, first, the compressed air introduced from the inlet portion 6 tries to pass through the space outlet E of the first partition wall P1. A part of the compressed air, however, cannot pass through the space outlet E because the part of the compressed air is blocked by the first partition wall P1, and returns to the inlet portion 6 side along the wall surface of the first partition wall P1. Then, the compressed air returned to the inlet portion 6 side heads toward the space outlet E side along the wall surface of the rear seal member 8*b*. As a result, a swirling flow RA of the compressed air around the orthogonal axis Y is generated.

In the second to fourth spaces S2 to S4, similarly to the first space S1, the compressed air which cannot pass through the space outlets E of the second to fourth partition walls P2 to P4 swirls around the orthogonal axis Y. Further, in the fifth space S5, the compressed air which cannot pass through the outlet portion 7 swirls around the orthogonal axis Y. In the present embodiment, since the inlet portion 6, the space outlets E of the partition walls P1 to P4, and the outlet portion 7 are alternately arranged at positions axially symmetric with respect to the pipe axis X, the compressed air is alternately swirled in an opposite direction for each of the spaces S1 to S5.

According to the present embodiment, since the compressed air swirls in each of the spaces S1 to S5, the residence time of the compressed air in each of the spaces S1 to S5 can be lengthened. As a result, it is possible to sufficiently promote heat exchange between the compressed air and the engine cooling water.

Further, since each of the first to fourth partition walls P1 to P4 of the present embodiment is formed in a C shape, the flow path area of the space outlet E is formed narrow. As a result, it is difficult for the compressed air to pass through the space outlet E, and the amount of compressed air swirling around the orthogonal axis Y can be increased.

The above-mentioned basic embodiment can be modification examples or a combination thereof as follows. In the following description, the same components as those in the above embodiment will be indicated with the same reference numerals and letters, and detailed description thereof will be omitted.

First Modification Example

In the above basic embodiment, the air flow path 5 is divided into five spaces S1 to S5 by providing four partition walls P1 to P4, but the number of partition walls and spaces may be freely selected.

Figure 9:
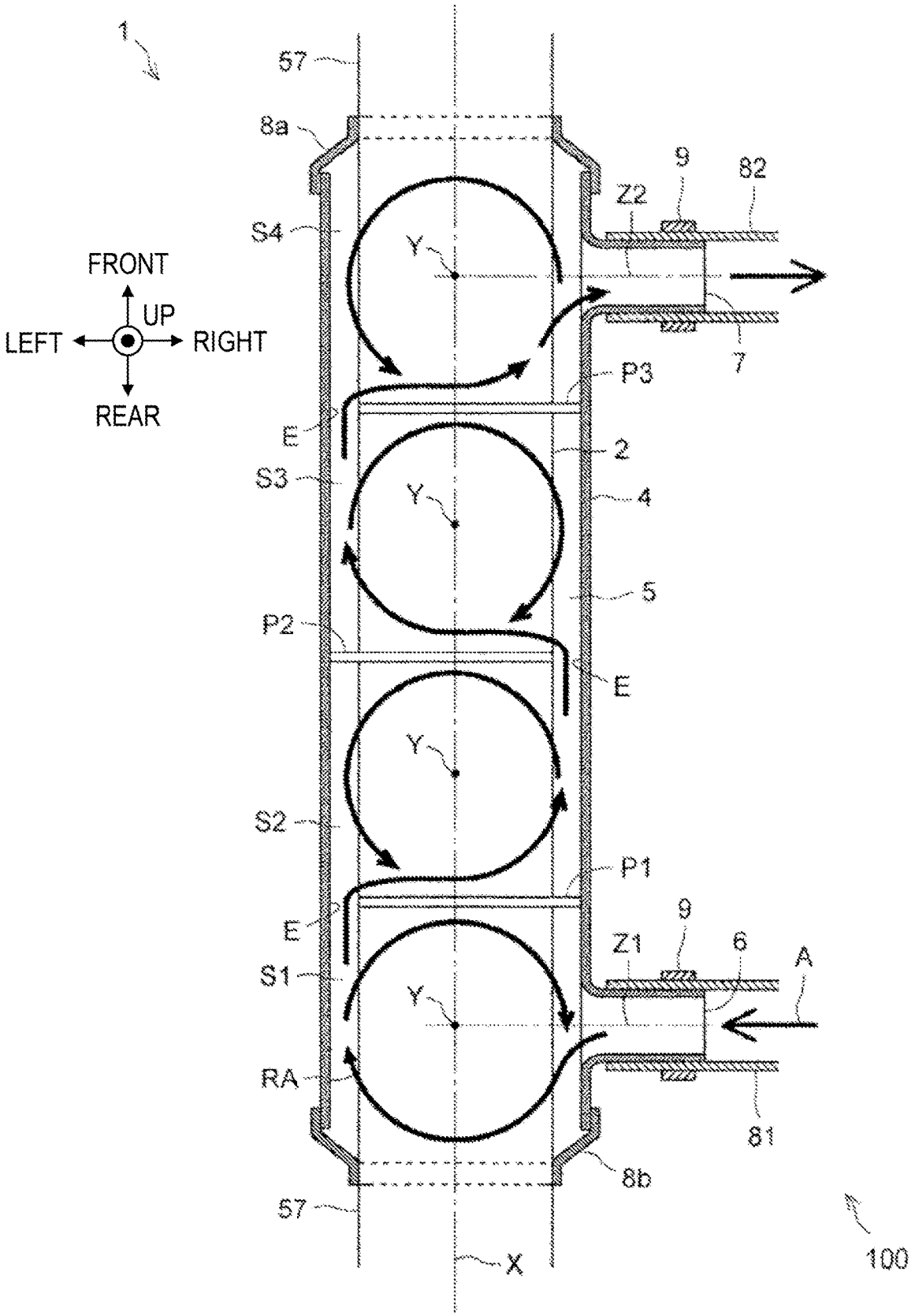
FIG. 9 is a top view illustrating a flow of the second fluid (compressed air) in a heat exchanger of a first modification example.

As illustrated in FIG. 9, in the first modification example, the air flow path 5 is divided into four spaces S1 to S4 and providing only the first to third partition walls P1 to P3, by omitting the fourth partition wall P4. In the first modification example, the inlet portion 6 and the outlet portion 7 are arranged at the same positions in the circumferential direction of the outer pipe 4, but the number of partition walls P1 to P3 is an odd number (three). Therefore, the inlet portion 6, the space outlets E of the partition walls P1 to P3, and the outlet portion 7 can be alternately arranged at positions axially symmetric with respect to the pipe axis X.

Second Modification Example

Blow-by gas may be recirculated to the intake pipe or the exhaust pipe, through the blow-by gas pipe, without being released into the atmosphere from the blow-by gas pipe.

Figure 10:
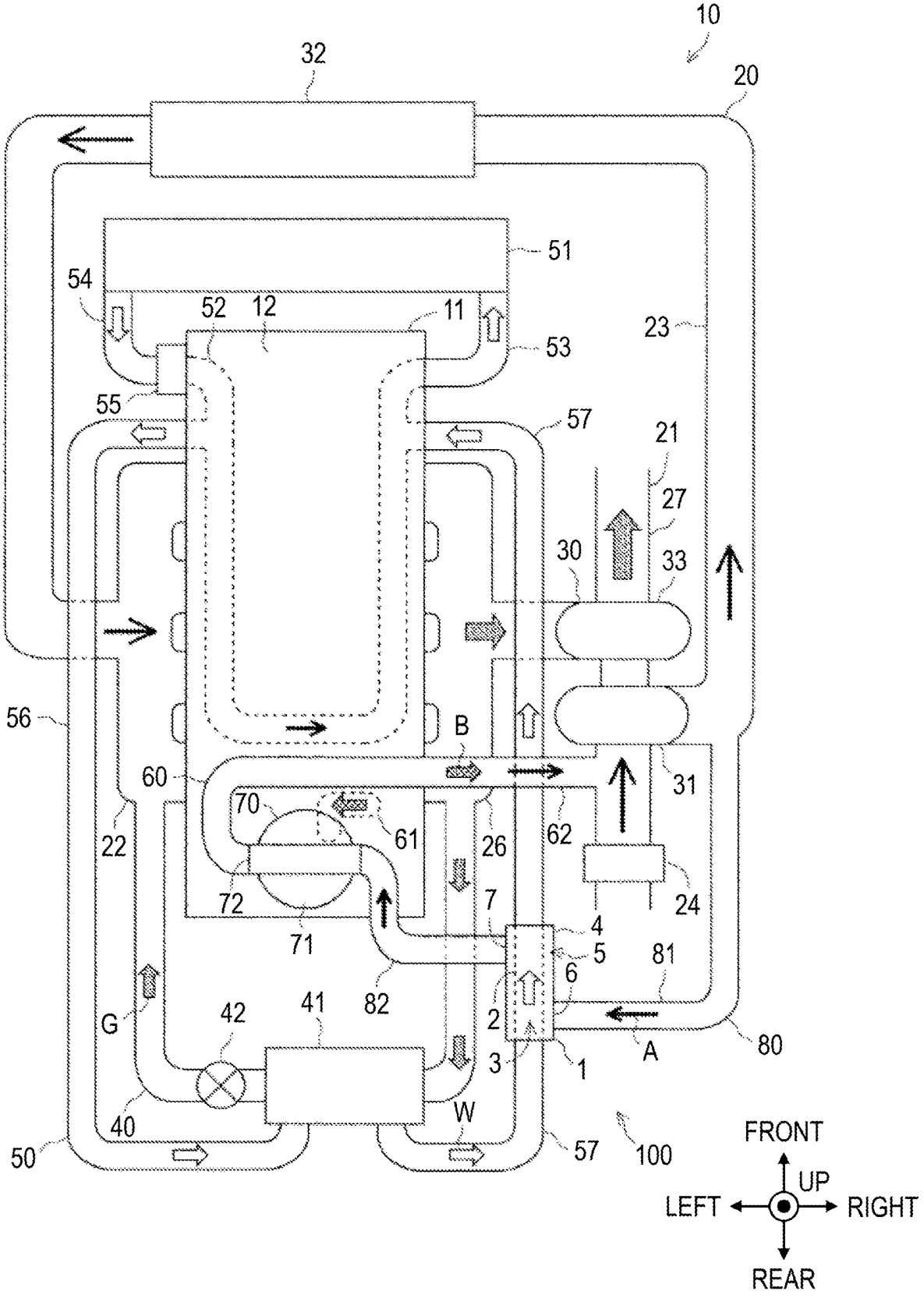
FIG. 10 is an overall configuration diagram of an internal combustion engine including a blow-by gas processing device of a second modification example.

As illustrated in FIG. 10, in the second modification example, the downstream end of the blow-by gas pipe 62 is connected to the intake pipe 23 located between the air cleaner 24 and the compressor 31.

In the second modification example, in a case where it is assumed that the heat exchanger 1 is not provided in the air passage 80, the high-temperature compressed air introduced into the oil separator 70 raises the temperature of the blow-by gas, and the oil remaining in the blow-by gas that cannot be completely separated by the oil separator 70 may become highly viscous. As a result, the highly viscous oil may adhere to the compressor 31 and cause an abnormality (caulking abnormality), and the original performance of the compressor 31 may not be exhibited.

However, according to the second modification example, since the high-temperature compressed air taken out from the intake pipe 23 to the air passage 80 can be cooled by the heat exchanger 1, it is possible to reduce the temperature rise of the blow-by gas due to the compressed air. As a result, it is possible to reduce the occurrence of caulking abnormality of the compressor 31 caused by the oil remaining in the blow-by gas.

Further, in the second modification example, in a case where it is assumed that the heat exchanger 1 is not provided in the air passage 80, the low-temperature compressed air introduced into the oil separator 70 may excessively lower the temperature of the blow-by gas, and the moisture contained in the blow-by gas may adhere to the inside of the blow-by gas pipe 62 or the intake pipe 23 and freeze to cause blockage. In addition, the frozen ice may be washed away downstream and damage the compressor 31.

On the other hand, according to the second modification example, since the low-temperature compressed air taken out from the intake pipe 23 to the air passage 80 can be heated by the heat exchanger 1, it is possible to prevent the temperature of the blow-by gas from being excessively lowered by the compressed air. As a result, it is possible to reduce the blockage of the blow-by gas pipe 62 and the damage to the compressor 31 due to the freezing of the moisture contained in the blow-by gas.

Third Modification Example

Although not illustrated, the refrigerant which exchanges heat with compressed air may be the engine cooling water flowing through the water feed pipe 56 further on the upstream side than the EGR cooler 41. Specifically, the inner pipe of the third modification example is provided in the middle of the water feed pipe 56 connected to the EGR cooler 41.

Fourth Modification Example

The refrigerant which exchanges heat with the compressed air may be engine cooling water flowing through the water supply pipe 53 or the return pipe 54 connected to the radiator 51. Specifically, the inner pipe of the fourth modification example is provided in the middle of the water supply pipe 53 or the return pipe 54.

Although the embodiments of the present disclosure are described in detail above, the embodiments of the present disclosure are not limited to the above-described embodiments. All modification examples, application examples, and equivalents contained in the ideas of the present disclosure as defined by the claims are included in the present disclosure. Therefore, the present disclosure should not be construed in a limited way and can be applied to any other technique that falls within the scope of the ideas of the present disclosure.

This application is based on a Japanese patent application filed on Sep. 17, 2019 (Japanese Patent Application No. 2019-168470), the contents of which are incorporated herein by reference.

INDUSTRIAL APPLICABILITY

According to the present disclosure, it is useful to provide a heat exchanger having a double pipe structure including an inner pipe and an outer pipe, which can sufficiently promote heat exchange, and an internal combustion engine blow-by gas processing device including the heat exchanger.

REFERENCE SIGNS LIST

1: heat exchanger
2: inner pipe
3: cooling water flow path (first flow path)
4: outer pipe
5: air flow path (second flow path)
6: inlet portion
7: outlet portion
10: internal combustion engine
20: intake passage
21: exhaust passage
30: turbocharger
31: compressor
32: intercooler
40: EGR pipe (EGR passage)
41: EGR cooler
50: cooling water passage
60: blow-by gas passage
70: oil separator

80: air passage
100: blow-by gas processing device
A: intake air, compressed air (first fluid)
B: blow-by gas
G: exhaust gas
P1 to P4: partition wall
S1 to S5: space
W: refrigerant, engine cooling water (second fluid)
X: pipe axis of outer pipe (first axis located in center of outer pipe)
Y: orthogonal axis with respect to pipe axis (second axis orthogonal to first axis)
Z1: central axis of inlet portion (third axis located in center of inlet portion)

The invention claimed is:

1. A heat exchanger, comprising:
an inner pipe;
a first flow path which is formed inside the inner pipe and through which a first fluid flows;
an outer pipe which is coaxially arranged on an outer side of the inner pipe in a radial direction;
a second flow path which is formed between the inner pipe and the outer pipe and through which a second fluid flows;
a partition wall which has an annular shape and which divides the second flow path into a plurality of spaces in an axial direction of the outer pipe; and
a space outlet which is formed at one location, in a circumferential direction, of the partition wall and which allows the second fluid to flow from the space on an upstream side to the space on a downstream side,
wherein the space is configured to swirl the second fluid around a second axis orthogonal to a first axis located at a center of the outer pipe,
wherein the heat exchanger is included in a blow-by gas processing device for an internal combustion engine,
wherein the internal combustion engine includes:
an intake passage;
a compressor of a turbocharger which is installed in the intake passage; and
a refrigerant passage through which refrigerant, as a first fluid, flows,
wherein the blow-by gas processing device further includes:
a blow-by gas passage through which blow-by gas flows;
an oil separator which is provided in the blow-by gas passage and which separates oil from blow-by gas by using compressed air, as a second fluid, generated by the compressor; and
an air passage which takes out compressed air from the intake passage further on the downstream side than the compressor and which introduces the compressed air into the oil separator,
wherein refrigerant is introduced into a first flow path of the heat exchanger from the refrigerant passage, and
wherein a second flow path of the heat exchanger forms a part of the air passage.

2. The heat exchanger according to claim 1, wherein the partition wall is formed in a C shape.

3. The heat exchanger according to claim 1, further comprising:
an inlet portion which is formed on an outer peripheral surface of the outer pipe and which introduces the second fluid into the second flow path,
wherein a third axis located at a center of the inlet portion is orthogonal to the first axis and the second axis.

4. The heat exchanger according to claim 1, wherein a length of the space in an axial direction of the first axis is set to be identical to an inner diameter of the outer pipe.

5. The heat exchanger according to claim 1, wherein a plurality of the partition walls are provided, and
wherein the space outlets of the partition walls adjacent to each other are arranged at positions axially symmetric with each other with respect to the first axis.

6. A blow-by gas processing device for an internal combustion engine, the internal combustion engine including:
a heat exchanger, comprising:
an inner pipe;
a first flow path which is formed inside the inner pipe and through which a first fluid flows;
an outer pipe which is coaxially arranged on an outer side of the inner pipe in a radial direction;
a second flow path which is formed between the inner pipe and the outer pipe and through which a second fluid flows;
a partition wall which has an annular shape and which divides the second flow path into a plurality of spaces in an axial direction of the outer pipe; and
a space outlet which is formed at one location, in a circumferential direction, of the partition wall and which allows the second fluid to flow from the space on an upstream side to the space on a downstream side,
wherein the space is configured to swirl the second fluid around a second axis orthogonal to a first axis located at a center of the outer pipe,
wherein the internal combustion engine includes:
an intake passage;
a compressor of a turbocharger which is installed in the intake passage; and
a refrigerant passage through which refrigerant, as a first fluid, flows,
wherein the blow-by gas processing device further includes:
a blow-by gas passage through which blow-by gas flows;
an oil separator which is provided in the blow-by gas passage and which separates oil from blow-by gas by using compressed air, as a second fluid, generated by the compressor; and
an air passage which takes out compressed air from the intake passage further on the downstream side than the compressor and which introduces the compressed air into the oil separator,
wherein refrigerant is introduced into a first flow path of the heat exchanger from the refrigerant passage, and
wherein a second flow path of the heat exchanger forms a part of the air passage.

7. The blow-by gas processing device according to claim 6, wherein the internal combustion engine further includes:
an EGR passage which recirculates EGR gas into the intake passage; and
an EGR cooler which is provided in the EGR passage and which exchanges heat between the EGR gas and refrigerant introduced from the refrigerant passage, and
wherein refrigerant discharged from the EGR cooler is introduced into the first flow path of the heat exchanger.

* * * * *